US008716628B2

(12) United States Patent
Bari et al.

(10) Patent No.: US 8,716,628 B2
(45) Date of Patent: May 6, 2014

(54) HOUSEHOLD APPLIANCES FOR WASHING AND/OR DRYING CLOTHES

(75) Inventors: Elisabetta Bari, Portogruaro (IT); Rica Pantermehl, Cordenons (IT); Nicola Reid, Pordenone (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 946 days.

(21) Appl. No.: 11/887,730

(22) PCT Filed: Mar. 13, 2006

(86) PCT No.: PCT/EP2006/060665

§ 371 (c)(1),
(2), (4) Date: Jan. 30, 2008

(87) PCT Pub. No.: WO2006/106026

PCT Pub. Date: Oct. 12, 2006

(65) Prior Publication Data

US 2009/0133285 A1 May 28, 2009

(30) Foreign Application Priority Data

Apr. 4, 2005 (EP) ..... 05102644

(51) Int. Cl.
*H05B 1/00* (2006.01)
*F26B 13/10* (2006.01)

(52) U.S. Cl.
USPC ..... 219/211; 219/476; 34/528

(58) Field of Classification Search
USPC ..... 219/220, 385, 521, 528, 541, 524, 543, 219/545, 411, 544, 548; 34/519, 619, 220, 34/491, 495, 239, 543, 201, 601–603, 427, 34/260
See application file for complete search history.

(56) References Cited

U.S. PATENT DOCUMENTS

| | | | | |
|---|---|---|---|---|
| 3,808,403 | A * | 4/1974 | Kanaya et al. | 219/528 |
| 4,538,365 | A | 9/1985 | Aho | |
| 4,924,604 | A | 5/1990 | Colodner et al. | |
| 6,080,974 | A | 6/2000 | Ambrosiano | |
| 6,407,365 | B1 * | 6/2002 | De Prete, III | 219/203 |
| 2003/0221333 | A1 | 12/2003 | Lam | |

FOREIGN PATENT DOCUMENTS

FR 1 140 786 8/1957

OTHER PUBLICATIONS

Mahcine Translation of EP 1431442.*
Machine Translation of EP 1 431 442.*
International Search Report mailed Jul. 11, 2006 in the International (PCT) Application No. PCT/EP2006/060665 of which the present application is the U.S. National Stage.
Written Opinion of the International Searching Authority mailed Jul. 11, 2006 in International (PCT) Application No. PCT/EP2006/060665 of which the present application is the U.S. National Stage.
Human translation of EP 1 431 442.

* cited by examiner

*Primary Examiner* — Brian Jennison
(74) *Attorney, Agent, or Firm* — Wenderoth, Lind & Ponack, L.L.P.

(57) ABSTRACT

A household appliance for washing and/or drying clothes comprises an outer casing provided with a worktop and a front panel carrying operational input controls, an opening for loading and unloading clothes, a door for closing the opening, a rotational drum supported inside the casing. The worktop comprises a heating unit to dry garments disposed on the worktop.

13 Claims, 6 Drawing Sheets

HOUSEHOLD APPLIANCES FOR WASHING AND/OR DRYING CLOTHES

BACKGROUND OF THE INVENTION

I. Field of the Invention

The present invention relates to household appliances for washing and/or drying clothes.

II. Description of Related Art

It is a largely known fact that garments made of delicate textiles such as cashmere are not adapted to be dried in tumble dryers due to mechanical impact on the textile fibers, which normally occur in dryers.

In order to care for delicate textiles, they need to be dried by means of more gentle treatment, such as line-drying or flat-drying, which are rather time consuming processes.

SUMMARY OF THE INVENTION

The aim of the present invention is therefore to provide a household appliance for gently drying clothes, eliminating the drawbacks of the cited known prior art.

An object of this invention is to provide a new drying solution for household appliances which is relatively simple in construction, trouble-free in operation, dependable, flexible in use and relatively inexpensive to manufacture, operate, service and maintain.

According to the present invention, this object is reached in a household appliance having the characteristics as recited and defined in the appended claims.

BRIEF DESCRIPTION OF THE DRAWINGS

Features and advantages of the present invention may be more readily understood from the description that is given below by way of a non-limiting example with reference to the accompanying drawings, in which.

DETAILED DESCRIPTION OF THE INVENTION

Figure 1:
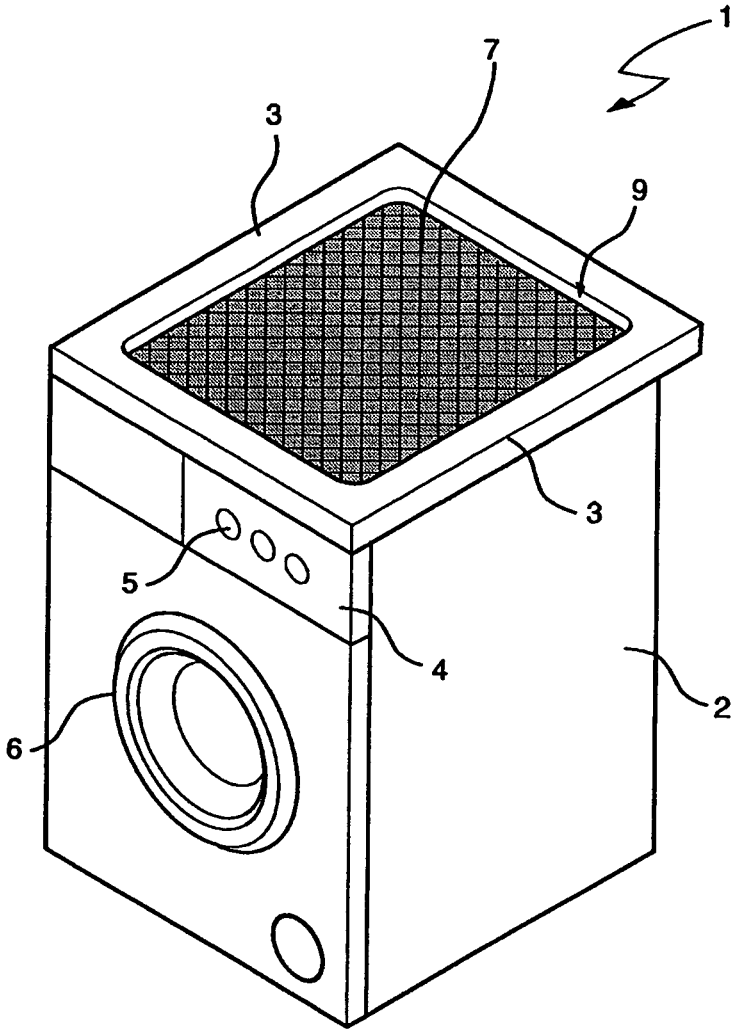
FIG. 1 is a perspective view of a household appliance according to the present invention.
Figure 2:
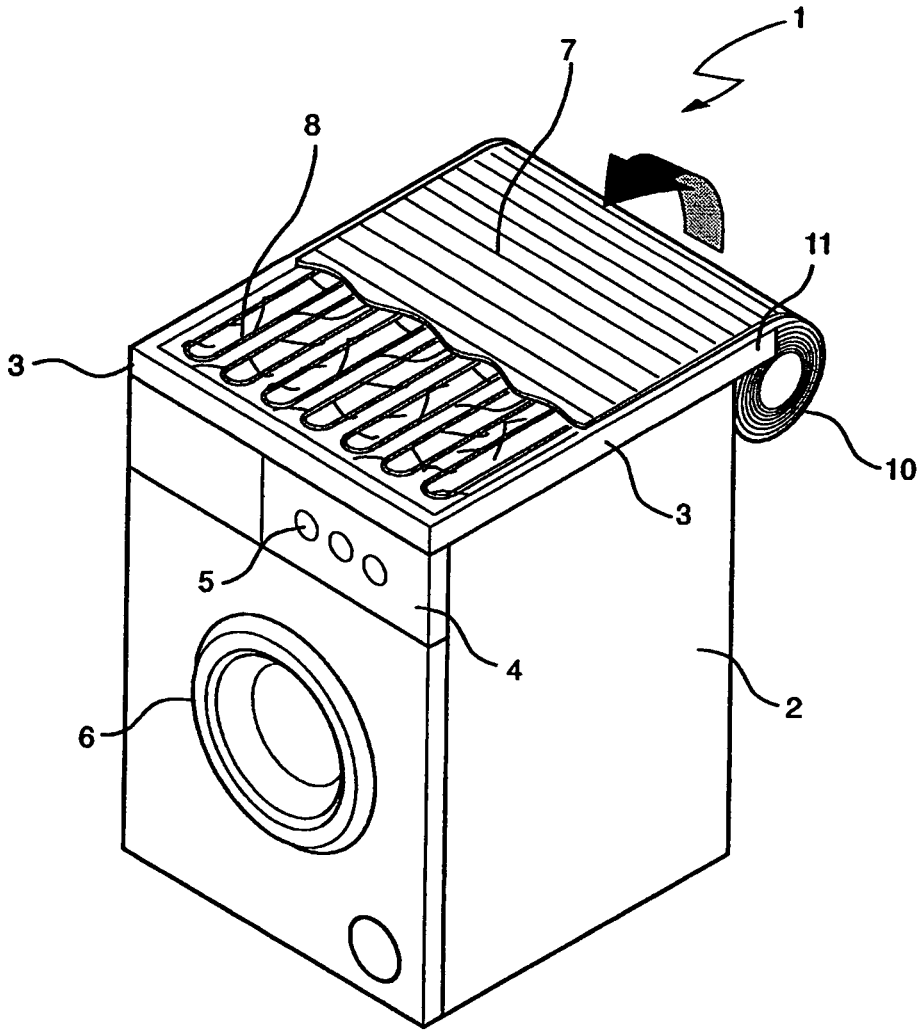
FIG. 2 is a perspective view of a household appliance according to a further embodiment of the present invention.
Figure 3:
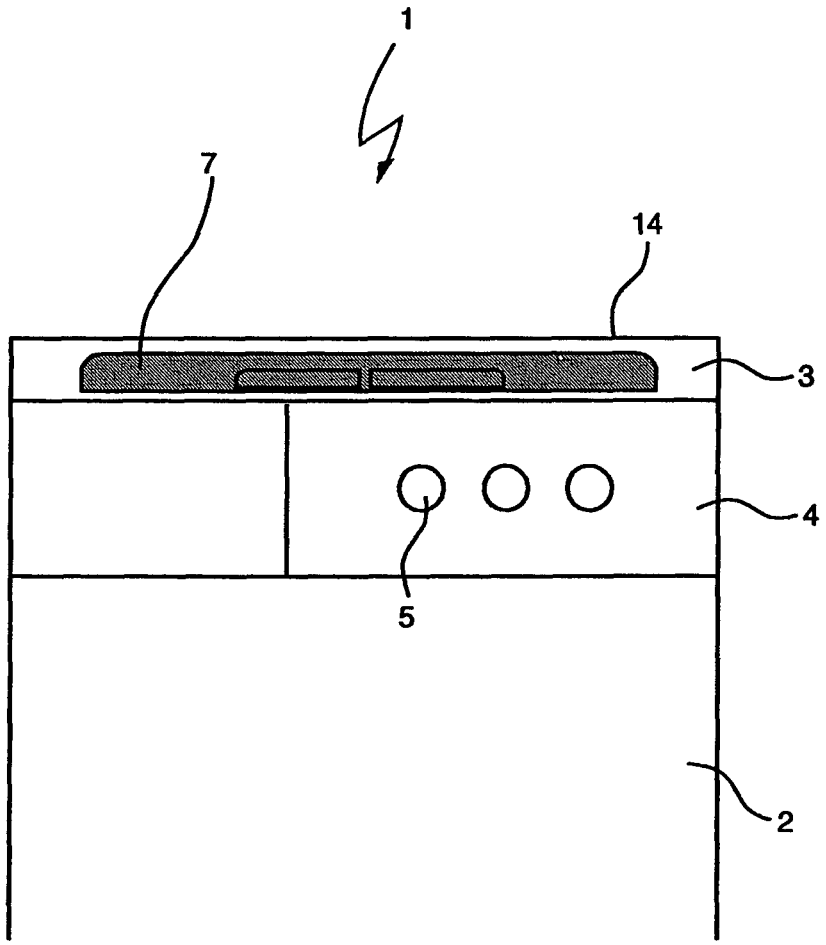
FIG. 3 is a front view of a household appliance according to a further embodiment of the present invention.
Figure 4:
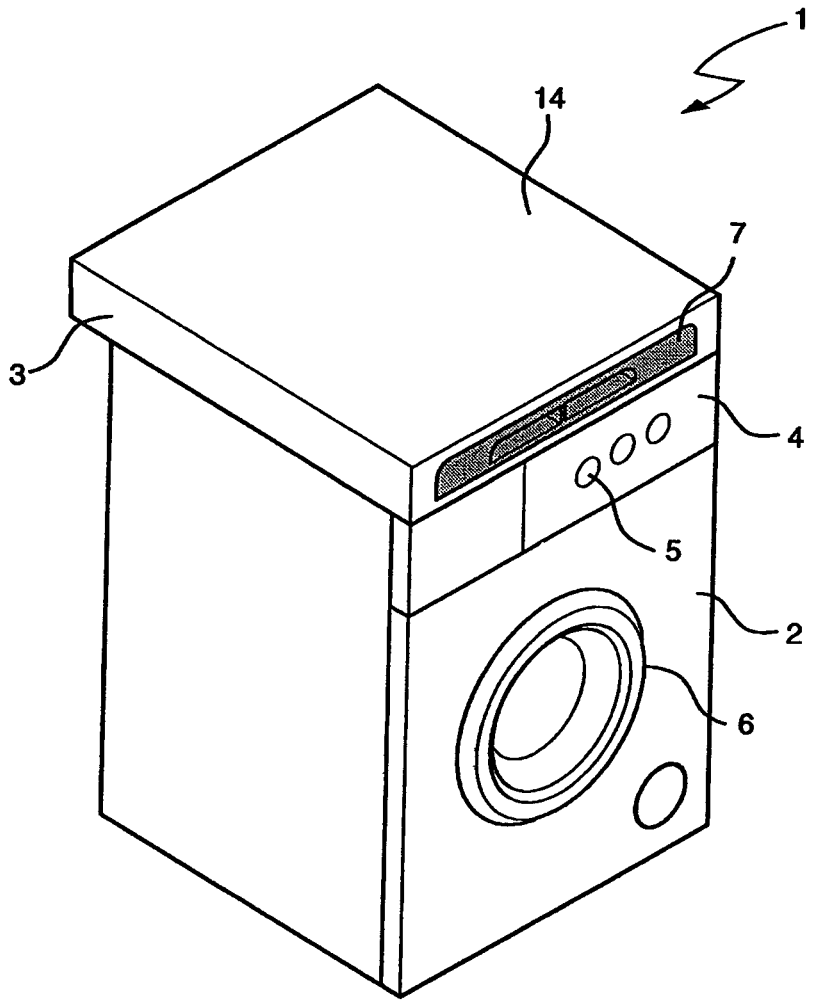
FIG. 4 is a perspective view of the household appliance of FIG. 3.
Figure 5:
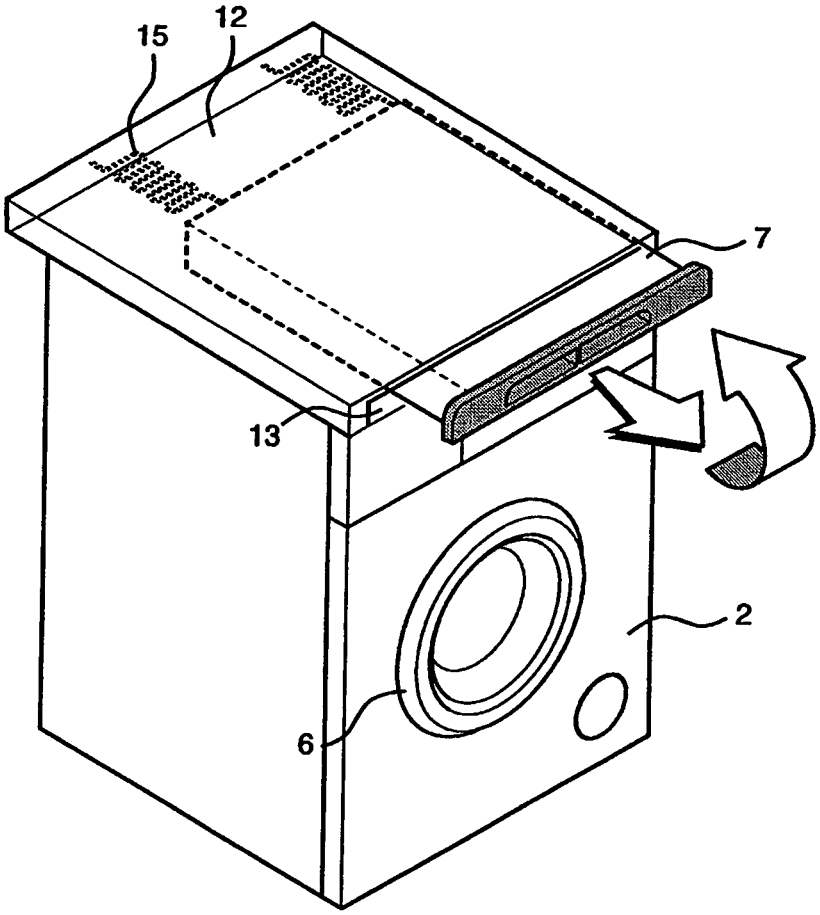
FIG. 5 is a sectional perspective view of the household appliance of FIG. 3 showing the heating mat.
Figure 6:
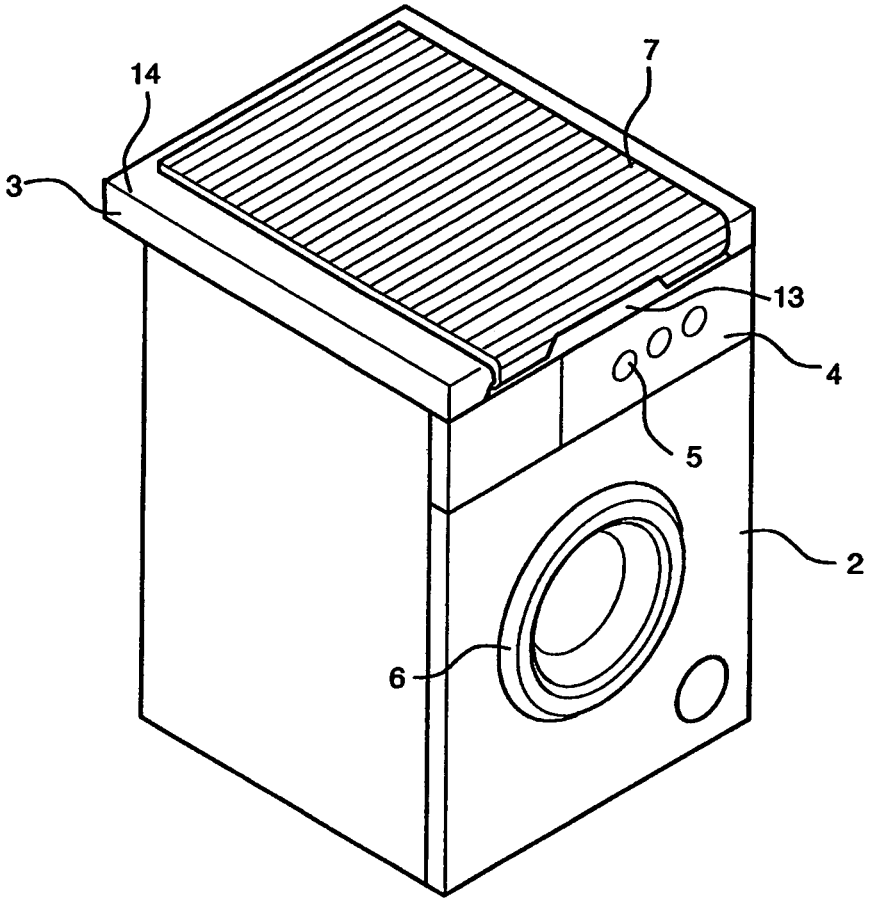
FIG. 6 is a perspective view of the household appliance of FIG. 3, showing the heating mat positioned thereon.

The household appliance for washing and/or drying clothes, according to the present invention, generally designated by the reference numerical 1, comprises an outer casing 2 with a worktop 3 and a front panel 4 carrying operational input controls 5, a drum rotatably supported inside the casing 2 and adapted to be loaded with items to be washed and/or dried, an opening for loading and unloading said items, a door 6 for closing the opening.

The worktop 3 comprises heating means or unit to dry clothes disposed on the worktop 3.

Such heating means comprise at least a heating layer associated with the worktop 3 and adapted to dry a garment in response to an applied electric current, the heating layer being connected to electric power terminals provided in correspondence to the worktop 3 and being arranged on the worktop 3 to support garments in a flat position.

Control means are provided on the front panel 4 of the household appliance in order to energize the heating layer and select different drying modes of the heating layer. It is noted that different drying temperatures and different drying times can be required depending on the particular type of the garment textile.

Conductive polymers can be envisaged to embody the heating layer.

Advantageously the heating layer is provided in the form of a heating mat 7 comprising an electric conductor embedded in insulating material in order to provide an even heat distribution and a low surface temperature. The heating mat 7 preferably includes a flexible resistor 8 disposed in an elastomeric material such as silicone rubber, neoprene or polyamide.

Clearly other type of polymeric material or natural rubber can be used for this purpose.

In a first embodiment of the present invention a central recess or seat 9 is provided on the worktop 3 in order to support the heating mat 7 in an operative position in which the heating mat 7 preferably lies flush with a peripheral portion worktop.

In a second embodiment the household appliance comprises coiling means 10 preferably arranged in correspondence to an upper backward portion of the casing 2. The coiling means 10 can be integrally formed in an outer edge 11 of the worktop 3. The heating mat 7 is removably associated to the coiling means or device 10 so as to be adapted to slide, due to the resilient properties thereof, between a first position in which the heating mat 7 is wound around the coiling means 10 and a second position in which the heating mat 7 lies flat on the worktop 3.

In a further embodiment the worktop comprises a housing 12 adapted to contain the heating mat 7 when the latter is not in use, the housing having an opening 13 through which the heating mat 7 is accessible by a user. The heating mat 7 is slidably associated to the worktop 3 in order to be drawn out from the housing 12 and arranged on a top portion 14 of the worktop 3. Expediently the heating mat 7 comprises a sliding hinge adapted to engage guiding means provided in the housing 12 of the worktop 3 so that the heating mat 7 can be pulled out from the housing 12 and rotated to be positioned on the top portion 14 of the worktop 3.

The resistor 8 of the heating mat 7 can be connected to extensible power supply cable 15 provided in the housing 12 or the sliding means can be provided integrally with electric power terminals adapted to energize the heating mat 7.

Clearly the heating means can be applied also to a top-loading household appliance.

Conclusively, it can therefore be stated that according to the present invention delicate textile can be dried in a gentle and effective way without large effort and without high energy consumption, thereby eliminating with the serious drawback shared by prior-art machines.

The invention claimed is:

1. A household appliance for washing and/or drying clothes, comprising:

an outer casing including a front wall, a rear wall, side walls and a worktop forming a top wall, said front wall including a front panel with operational input controls;

an opening for loading and unloading clothes;

a door for closing said opening; and a rotational drum supported inside said casing, wherein said worktop comprises a heating unit configured to dry garments disposed on said worktop, wherein said heating unit comprises at least a heating layer to dry garments in response to an applied electric current, said heating layer being disposed on said worktop so as to support garments in a flat position, and wherein said heating layer is a heating mat comprising one or more electric conductors embedded in insulating material.

2. A household appliance according claim 1, wherein a seat is disposed on a top surface of said worktop to support said heating mat in an operative flat position.

3. A household appliance according to claim 1, wherein said worktop includes a coiling device, and said heating mat is removably associated with said coiling device, such that when said heating mat is in a first position, said heating mat is wound around said coiling device, and when heating mat is in a second position, said heating mat is lying flat on said worktop, said heating mat being configured to slide between the first position and the second position.

4. A household appliance according to claim 1, wherein said worktop comprises a housing configured to contain said heating mat when said heating mat is not in use, said heating mat being slidably associated with said worktop so as to be drawn out from said housing and arranged on a top portion of said worktop.

5. A household appliance according to claim 1, wherein said heating unit is connected to electric power terminals provided in correspondence with said worktop.

6. A household appliance according to claim 1, wherein said heating unit is flexible.

7. A household appliance according to claim 1, wherein controls are provided on said front panel of said household appliance to energize said heating unit and select different drying modes of said heating device.

8. A household appliance according to claim 2, wherein said heating unit is connected to electric power terminals provided in correspondence with said worktop.

9. A household appliance according to claim 3, wherein said heating unit is connected to electric power terminals provided in correspondence with said worktop.

10. A household appliance according to claim 4, wherein said heating unit is connected to electric power terminals provided in correspondence with said worktop.

11. A household appliance according to claim 2, wherein said heating unit is flexible.

12. A household appliance according to claim 3, wherein said heating unit is flexible.

13. A household appliance according to claim 3, wherein said coiling device is integrally formed with an outer edge of said worktop.

* * * * *